US005577691A

United States Patent [19]

Erich et al.

[11] Patent Number: 5,577,691

[45] Date of Patent: Nov. 26, 1996

[54] SWITCH BLADE DEVICE IN A TURNOUT ON A TRAM-OR STREETCAR-TYPE LINE

[75] Inventors: Egger Erich, Wasendorf; Ossberger Heinz, Zeltweg, both of Austria

[73] Assignee: VAE Aktiengesellschaft, Vienna, Austria

[21] Appl. No.: 374,427

[22] Filed: Jan. 19, 1995

[30] Foreign Application Priority Data

Jan. 19, 1994 [AT] Austria ..... A91/94

[51] Int. Cl.[6] ..... E01B 7/00

[52] U.S. Cl. ..... 246/437; 246/442; 246/436; 246/443

[58] Field of Search ..... 246/436, 437, 246/460, 461, 463, 470, 443, 442; 238/129, 130, 140, 143, 145, 147, 146

[56] References Cited

U.S. PATENT DOCUMENTS

| | | | |
|---|---|---|---|
| 1,171,278 | 2/1916 | Thompson | 238/129 |
| 5,451,018 | 9/1995 | Heinze et al. | 246/437 |

FOREIGN PATENT DOCUMENTS

| | | | |
|---|---|---|---|
| 0515708A1 | 12/1992 | European Pat. Off. . | |
| 339857 | 6/1954 | France | 238/143 |
| 658687 | 11/1986 | Switzerland . | |
| 947 | of 1870 | United Kingdom | 238/144 |
| 9962 | of 1908 | United Kingdom | 238/143 |

*Primary Examiner*—Mark T. Le
*Attorney, Agent, or Firm*—Cushman Darby & Cushman

[57] ABSTRACT

In a switch blade (point-rail) device in a grooved-rail turnout on a tram- or streetcar-type line, switch blades (2) are detachably mounted, using a clamping wedge (5) which is fastened to a support part (6) by means of a screw (12) in an essentially perpendicular direction to the running surface. Once the clamping wedge (5) has been removed, the switch blade (2) can be demounted and lifted out. Mounting is performed by pressing an inclined lateral surface (7) of the switch blade (2) against a correspondingly inclined lateral surface (8) of the support part (6). The angles of inclination of the wedge, and of the contact surface of the support part, are matched to each other so that self-locking is achieved.

6 Claims, 2 Drawing Sheets

SWITCH BLADE DEVICE IN A TURNOUT ON A TRAM-OR STREETCAR-TYPE LINE

BACKGROUND OF THE INVENTION

1. Field of the Invention

This invention relates to a switch blade device in a turnout, on a tram- or streetcar-type line with grooved rails (known as "tram rails"), in which the switch blades (i.e. the tapering point-rails) are detachably connected to the normal rails.

2. Description of the Prior Art

Switch blade devices in a grooved-rail turnout are described in e.g. CH-PS 658 687. In this known design, the switch blade is butt-welded to a connecting rail. To prevent possible derailments, due to breaking of the butt-weld joint and resultant failure of the switch blade to kept in place in the joint region, a connection to a lateral rail that is fixed in position is provided by means of a bolt with a spacer. In this prior-art, wearing-parts cannot be easily replaced during maintenance without having to separate the welded joint.

EP-A1 515 708 has already disclosed a switch blade in which a switch blade section is secured by means of a wedge. In this prior-art detachable mounting arrangement using a wedge, however, the wedge is clearly introduced in the longitudinal direction of the rails; and therefore, during maintenance work, covering elements—and even road asphalt attaching to the rails—have to be removed over a considerable area to gain access to the separable joint.

SUMMARY OF THE INVENTION

The present invention aims to create a separable connection for a switch blade in a switch blade device in a grooved-rail turnout, whereby it is possible to replace the switch blades in an extremely short space of time, without extra work effort and without having to break the asphalt surfacing or other parts of the road surfacing, while at the same time ensuring continued operational safety even in the event of damaged or broken locking elements. Switch blade devices in grooved-track turnouts are generally used in city traffic, and therefore minimization of the time required for repair works and a reduction in noise pollution are provided, because switch blade replacement work normally has to be done at times when public transport is not running.

To achieve the aim of the invention, it is proposed:

that the switch blade be secured in the mounting area by at least one clamping wedge which can be tightened up, against one of the lateral edges of the switch blade, in a direction essentially perpendicular to the running surface thereof;

that the side of the switch blade opposite the clamping wedge be overlapped, in the mounting region, by an inclined surface of a support part or holding part for the switch blade; and that the inclined surface of the support part be inclined at an angle to the plane of travel that is smaller than the exterior angle of the inclined surface of the support part co-acting with the clamping wedge.

The fact that the switch blade is secured in the mounting area by means of at least one clamping wedge, which can be tightened essentially at right angles to the running surface, means that the clamping wedge can be readily lifted out and replaced, and that lateral covering areas—particularly asphalt surfaces or parts of the roadway—do not have to be removed in order to permit maintenance work and the replacement of wearing parts. Due to the fact that, in the mounting region, the side of the switch blade opposite the clamping wedge is overlapped by an inclined surface of the support part or holding part for the switch blade, it is possible to simply lift the blade out after untightening the clamping wedge, with a minimum of time and work effort. At the same time, the amount of noise pollution generated by such maintenance work can be reduced to a minimum. As the frequency of public transport is constantly increasing, and thus little time is available for replacing worn parts, this method of mounting the switch blade constitutes a significant improvement in the operation of this type of turnout. In order to ensure operational reliability, even with high alternating bending stress and high impact-stress, the design according to the invention is such that the angle of inclination, to the plane of travel, of the inclined surface of the support part [co-acting with the inclined contact-surface of the switch blade] is less than the exterior angle of the inclined surface of the support part co-acting with the clamping wedge. Due to this arrangement of the angles, a kind of self-locking is achieved, whereby the wedges and switch blade cannot work loose by themselves even when subjected to impact loads.

In order to ensure the required operational reliability—and particularly the required integrity of the joint in the longitudinal direction of the rails—in a switch-blade mounting arrangement of this type using a clamping wedge, it is advantageous for the design to be such that the switch blade has recesses in, or projections on, its bottom surface (i.e. its surface opposite the running surface), which co-act with projections, inserts, or recesses in the support part in the longitudinal direction of the switch blade, serving as stops to limit longitudinal shifting. The forces occurring in the longitudinal direction of the rails are thus absorbed by such recesses or projections in the bottom surface of the switch blade, and once the wedge has been untightened, no additional measures are required to lift out a worn blade.

It is particularly advantageous if the clamping wedge is connected to the support part by means of a threaded bolt; and in order to improve traffic safety and prevent the drive of the bolt from getting dirty, a further development of the design is advantageous in which the clamping wedge and the screw bolt are covered by an occluding wedge connected flush to the support part.

To avoid double fitting and to ensure accurate positioning of the wedge-surfaces of the switch blade in the substructure, it is advantageous if the design is such that the stops for limiting the longitudinal movement of the switch blade are constituted by inserts connected to the support part and fitting, with play, into recesses in the bottom surface of the switch blade.

To replace a switch blade, in the design according to the invention, it is merely necessary to untighten the wedge and lift it out, whereupon the switch blade can likewise be lifted out and replaced without any further time-consuming measures. To make it easier to loosen the wedge, it is advantageous if the clamping wedge has at least one threaded hole running through it parallel to the axis of the screw bolt in the clamping wedge. A loosening screw can be screwed into such a threaded hole, to push the clamping wedge out of its self-locking position. This is best achieved with at least two such threaded holes appropriately arranged so that the loosening forces can be suitably applied to achieve the desired effect.

BRIEF DESCRIPTION OF THE DRAWING

The invention will now be described in greater detail with reference to one example thereof, represented diagrammatically in a drawing, in which.

DESCRIPTION OF THE PREFERRED EMBODIMENT OF THE INVENTION

Figure 1:
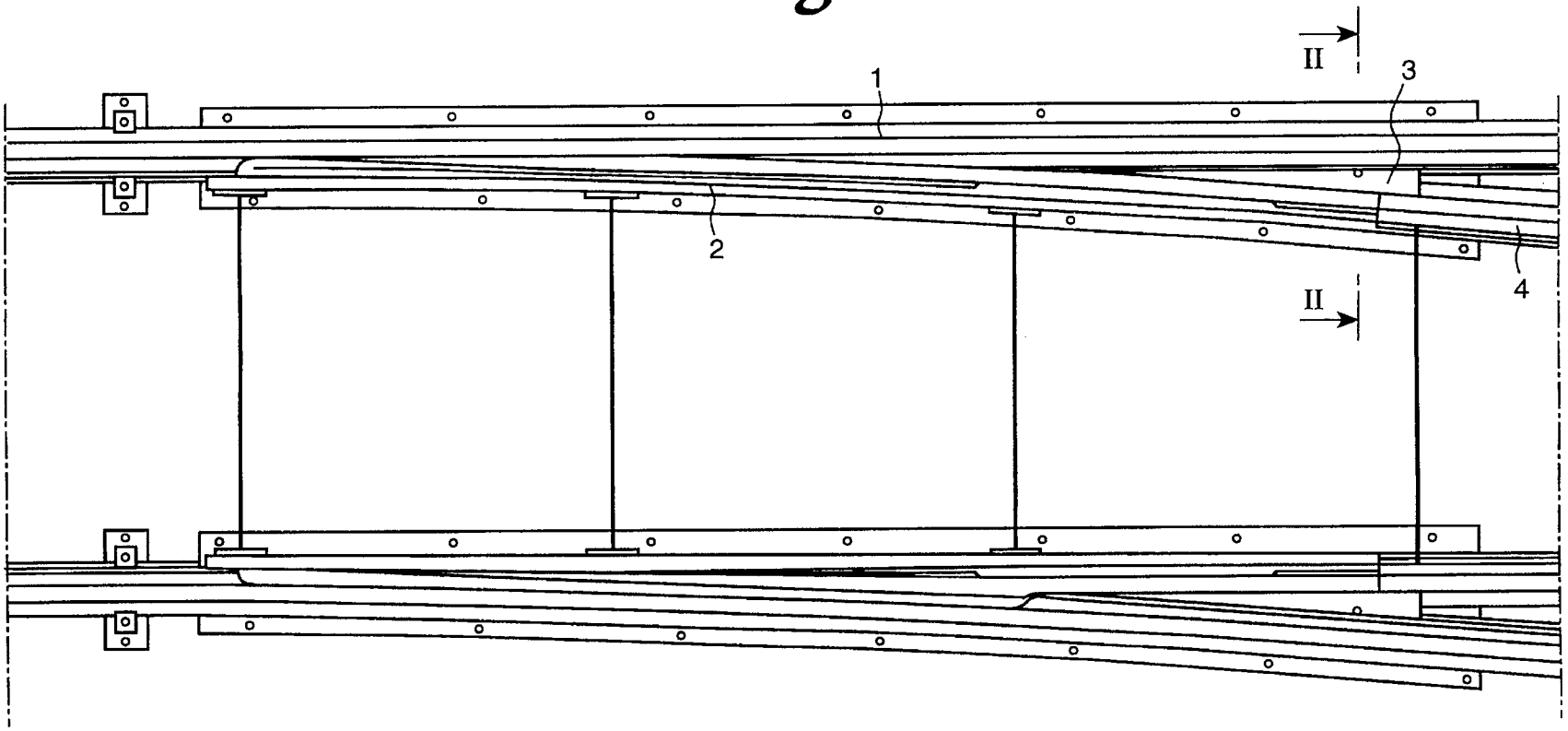
FIG. 1 is top view of a switch blade device according to the invention.

FIG. 1 shows a grooved rail, marked 1, against which a switch blade 2 is mounted in the region marked 3. The switch blade 2 is moved into position against the respective grooved rail by means of an actuating mechanism (not shown). The switch blade 2 is detachably connected to a connecting rail 4. The connection, in the region marked 3, is shown in an enlarged sectional view in FIG. 2, the section being taken at line II/II.

Figure 2:
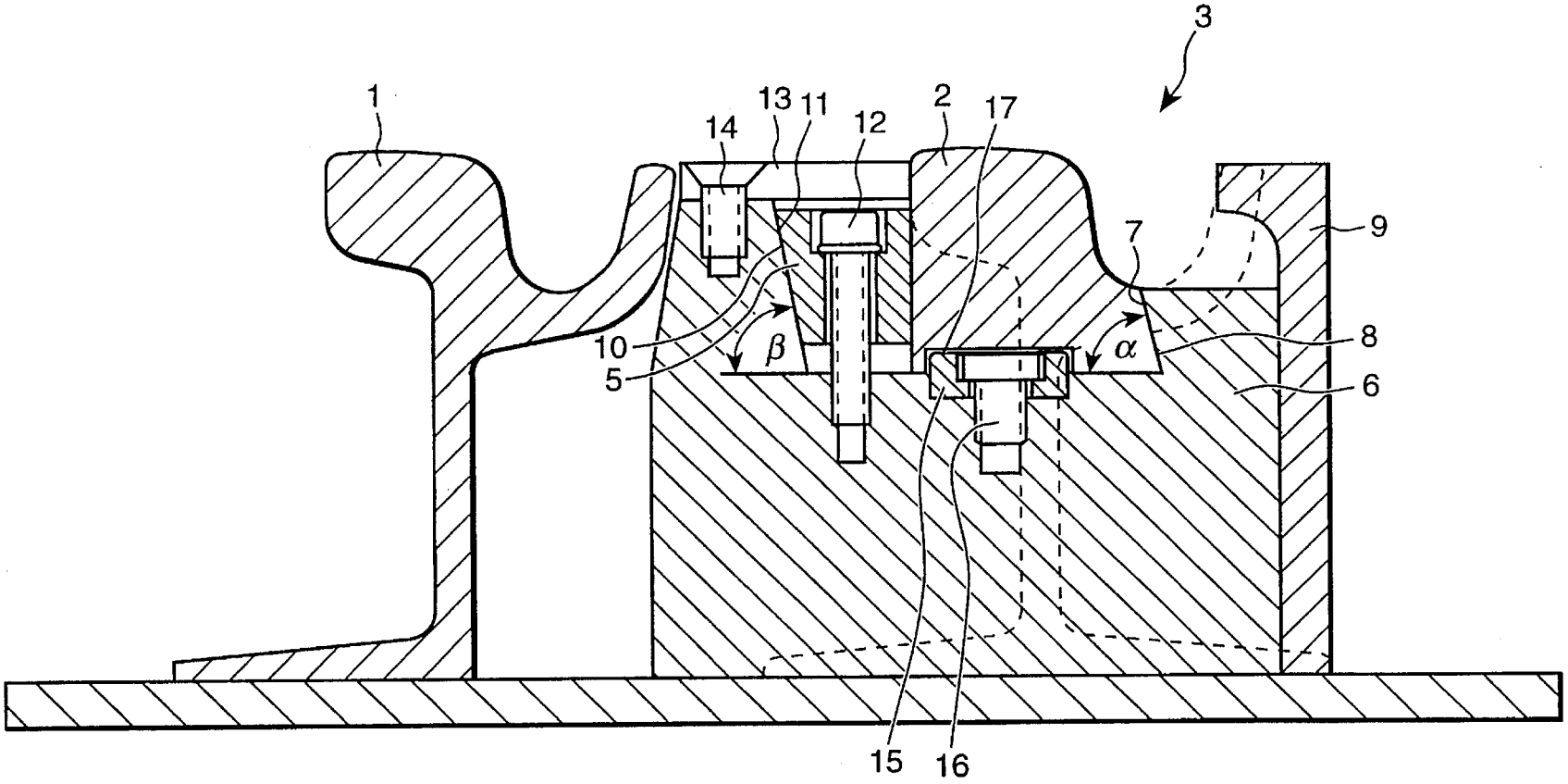
FIG. 2 is a sectional view, at line II/II in FIG. 1, showing details of the mounting of the switch blade.

The grooved rail 1 is again shown in FIG. 2. In the mounting region 3, the switch blade 2 is pressed against a support part 6 by a clamping wedge 5; the switch blade 2 has an inclined contact surface 7, which co-acts with a corresponding inclined surface 8 on the support part 6. An auxiliary rail 9 adjoins the support part 6.

The inclined surface 7 forms an angle $\alpha$ to horizontal which is smaller than the angle $\beta$ to horizontal between the contact surface 10 of the support part and the corresponding inclined surface 11 of the clamping wedge. The clamping wedge 5 is connected to the support part 6 by means of a screw bolt inserted in an essentially vertical direction. As the screw bolt 12 is screwed in, the clamping wedge 5, supported on the inclined surface 10, presses the switch blade 2 against the inclined surface 7 of the support part 6. To cover the screw bolt 12, an occluding wedge 13 is provided, which is screwed to the base part 6 by means of a screw 14.

To release the switch blade, it is merely necessary to remove the occluding wedge 13 and screw out the screw bolt 12. Once the clamping wedge has been removed, the switch blade can be directly lifted out. In order to secure the switch blade in the longitudinal direction of the rail as well, inserts 15 are screwed to the base part 6, by means of screws 16, and engage in recesses 17 in the bottom surface of the switch blade, with play. The amount of play must be sufficient to avoid interference when the wedge is being tightened, and to ensure that the inclined surface 7 of the switch blade 2 is pressed securely against the inclined surface 8 of the base part 6.

We claim:

1. An apparatus in a turnout on a tram or streetcar line employing grooved rails, comprising a switch blade selectively secured to a support;

a recess provided in said support for receiving a portion of the switch blade and a tightening wedge, the recess having a first inclined surface complementary to an inclined surface on one side of the wedge and a second inclined surface complementary to an inclined surface on one side of the portion of the switch blade received in the recess, said first inclined surface being disposed at a substantially larger angle to the horizontal than said second inclined surface, said wedge being removably disposed within the recess wherein a surface of the wedge opposite said one side of the wedge engages a surface of the switch blade opposite said one side of the switch blade; and means for advancing the wedge within the recess wherein the wedge applies force against the switch blade to clamp the switch blade against the support with the switch blade's inclined surface engaging the recess second inclined surface.

2. An apparatus according to claim 1, further comprising means for preventing movement of the switch blade relative to the support in a direction longitudinally of the switch blade.

3. An apparatus according to claims 1 or 2, wherein said advancing means comprises a screw bolt which removably connects the wedge to the support.

4. An apparatus according to claims 1 or 2, further comprising an occluding wedge flush-connected to the support to cover the tightening wedge.

5. An apparatus according to claim 3, further comprising an occluding wedge flush-connected to the support to cover the tightening wedge and the screw bolt.

6. An apparatus according to claim 2, wherein said movement preventing means includes at least one additional recess in the bottom of the first-mentioned recess in said support, said additional recess being aligned with a recess in the bottom of the portion of the switch blade received in the support, and an insert positioned within the aligned recesses and connected to the support, said insert being dimensioned to permit lateral movement of switch blade relative to the support.

* * * * *